US005256042A

United States Patent [19]

McCullough et al.

[11] Patent Number: 5,256,042

[45] Date of Patent: Oct. 26, 1993

[54] BEARING AND LUBRICATION SYSTEM FOR A SCROLL FLUID DEVICE

[75] Inventors: John E. McCullough, Carlisle; Ronald J. Forni, Lexington; Robert M. Lucas, Lynnfield, all of Mass.

[73] Assignee: Arthur D. Little, Inc., Cambridge, Mass.

[21] Appl. No.: 837,979

[22] Filed: Feb. 20, 1992

[51] Int. Cl.[5] ..... F01C 1/04; F01C 21/04

[52] U.S. Cl. ..... 418/1; 418/55.3; 418/55.5; 418/55.6; 418/88

[58] Field of Search ..... 418/1, 55.3, 55.5, 55.6, 418/88, 98, 188

[56] References Cited

U.S. PATENT DOCUMENTS

| | | | |
|---|---|---|---|
| 4,575,320 | 3/1986 | Kobayashi et al. | 418/55.6 |
| 4,610,610 | 9/1986 | Blain | 418/55.5 |
| 4,735,559 | 4/1988 | Morishita et al. | 418/55.6 |
| 4,846,639 | 7/1989 | Morishita et al. | 418/55.5 |
| 4,927,340 | 5/1990 | McCullough | 418/55.5 |
| 4,954,057 | 9/1990 | Caillat et al. | 418/55.6 |
| 4,993,929 | 2/1991 | Weatherston | 418/55.6 |
| 5,129,798 | 7/1992 | Crum et al. | 418/55.5 |
| 5,133,651 | 7/1992 | Onoda et al. | 418/55.6 |

FOREIGN PATENT DOCUMENTS

| | | | |
|---|---|---|---|
| 61-205385 | 9/1986 | Japan | 418/55.6 |
| 61-268896 | 11/1986 | Japan | 418/55.6 |
| 1-63694 | 3/1989 | Japan | 418/55.6 |
| 2-227578 | 9/1990 | Japan | 418/55.6 |
| 2-305390 | 12/1990 | Japan | 418/55.6 |
| 3-11180 | 1/1991 | Japan | 418/188 |
| 3194180 | 8/1991 | Japan | 418/55.6 |
| WO91/18207 | 11/1991 | PCT Int'l Appl. | 418/55.5 |

*Primary Examiner*—John J. Vrablik

*Attorney, Agent, or Firm*—Bacon & Thomas

[57] ABSTRACT

A bearing and lubrication system for a sealed, integrated motor driven co-rotating scroll refrigerant compressor includes hydrostatic bearings and an independent motor driven lubricant supply pump for supplying lubricant to the hydrostatic bearings mounting in the housing. The housing is divided into a high-pressure section that receives compressed refrigerant and a low pressure section containing the involute scroll compressor wraps. Individual lubricant supply sumps are provided in the high and lower pressure housing sections for supplying lubricant to the compressor bearings. The lubricant pump is capable of drawing lubricant from one or both of the lubricant supply sumps. A lubricant level sensor associated with one of the low or high pressure housing sumps is provided to maintain a desired level of lubricant therein. The lubricant supply pump is controlled so that pressure is supplied to the hydrostatic bearings during compressor operation. The lubricant may be pressurized by compressed refrigerant in the high-pressure housing section for supply to the compressor bearings with or without operation of the lubricant supply pump.

24 Claims, 8 Drawing Sheets

BEARING AND LUBRICATION SYSTEM FOR A SCROLL FLUID DEVICE

BACKGROUND OF THE INVENTION

1. Field of the Invention

The present invention pertains to a bearing and lubrication system for use in scroll fluid devices. The bearings utilized are hydrostatic/hydrodynamic in nature yet permit sufficient leakage for lubricating relative rotatable members of the scroll fluid device.

2. Related Background Technology and Art

Scroll fluid devices are known which comprise a pair of opposed meshed axially extending involute wrap elements which co-rotate and are supported for orbital motion relative to each other to create radially moving progressively and periodically varying volume fluid transporting chambers between the wrap elements. When the involute wrap elements are rotated at high speeds within a housing to expand or compress a fluid medium, a considerable amount of axial and radial force tending to separate the spiral wraps is generated. In order for the scroll fluid device to operate, these axial and radial forces must be opposed. In addition, a sufficient amount of lubricating fluid must be provided between the relatively rotating parts of the scroll fluid device to minimize wear and to prevent excessive operating temperatures resulting from friction.

It is known in the prior art to provide fluid bearings in order to counteract these axial and radial forces developed in high speed scroll fluid devices. In U.S. Pat. No. 4,993,929, for example, a scroll-type machine is disclosed which incorporates a self-pressurizing hydrostatic thrust bearing used to maintain a constant interface of oil between the axial thrust surfaces of the scroll elements and the housing. As stated in the patent, the oil film thickness in the thrust bearing chambers are on the order of 1 mil in order to prevent dissipative action of the oil from this high pressure chamber to the surrounding low pressure areas. In such a system, a separate lubrication circuit must be provided in addition to the fluid circuit used to supply the thrust bearings since the bearing chamber arrangements are designed to prevent the dissipation of oil therefrom. This auxiliary lubrication system supplies a lubricating film layer between the relative rotatable parts of the scroll fluid device and housing.

In U.S. Pat. No. 4,874,302, a scroll fluid compressor is disclosed which includes a hydrodynamic thrust bearing interposed between an orbiting scroll member and a bearing support which not only functions to provide axial reactive force to the orbiting scroll member but also admits lubricating fluid into guiding grooves associated with the synchronizer used between the intermeshed scroll members. In the '302 patent, the scroll type compressor includes one fixed scroll member and a second orbiting scroll member. In general, the oil film thickness in such known hydrodynamic thrust bearings is typically quite small, on the order of 1 mil. If this type of bearing arrangement was utilized in a high-speed, high output, co-rotating scroll compressor, it could not adequately counteract the axial thrust forces developed and would result in excessive power losses at high speed and high oil temperatures. Since the oil film thickness in typical hydrodynamic thrust bearings is quite small, a very stiff and massive bearing plate having a large oil film surface area is usually required. In a high-speed co-rotating scroll environment, a large massive bearing plate can create efficiency losses due to the power required to rotate the plate as well as vibrational problems.

Therefore, a need exists for a thrust bearing arrangement for use in a high-speed, co-rotating scroll fluid device which not only can adequately counteract the radial and axial forces developed during operation of the scroll device but which can be used with a single oil supply system which provides lubrication between the relatively rotating parts of the scroll fluid device. In addition, there exits a need for a thrust bearing and lubrication system which will maintain operating stability and will enhance operating efficiency.

SUMMARY OF THE INVENTION

This invention has for one of its objects the improvement of the efficiency of a sealed, co-rotating high speed scroll fluid device by providing hydrostatic thrust bearings to carry axial loads which can operate with a large oil film thickness in order to reduce temperature and power losses of the bearing. In addition, it is an object of the present invention to utilize journal bearings to carry radial loads which posses characteristics of hydrodynamic and hydrostatic bearings in that oil is permitted to leak from the bearings to provide lubrication for the relatively rotating elements of the scroll fluid device.

The aforesaid objectives are realized in accordance with this invention by providing both axial acting and radially acting bearings on the intermeshed involute spiral wraps of the scroll fluid device; by permitting a predetermined amount of lubrication oil to leak from the thrust and journal bearings between relatively rotating elements of the scroll fluid device; by directing the flow of lubricating oil from these bearings to the sump along paths which minimize any heat transfer between the hot lubricating oil and the inlet refrigerant gas; and by providing an oil system control arrangement which manages the flow of oil from at least one sump to the bearings.

While this invention will be described in the context of a sealed, co-rotating scroll system used as a refrigerant compressor, it will be understood that the invention has similar application in any scroll fluid device system, whether co-rotating or not, where it is desirable to use hydrostatic bearings which include characteristics of hydrodynamic bearings and a single bearing and lubricating oil supply system.

DETAILED DESCRIPTION OF THE PREFERRED EMBODIMENTS

Although the present invention may be applied to various types of scroll fluid devices, it is depicted and described for exemplary purposes embodied in a hermetically sealed co-rotating scroll type refrigerant compressor which is adapted to be used in a closed-loop evaporator-condenser refrigeration system.

Figure 1:
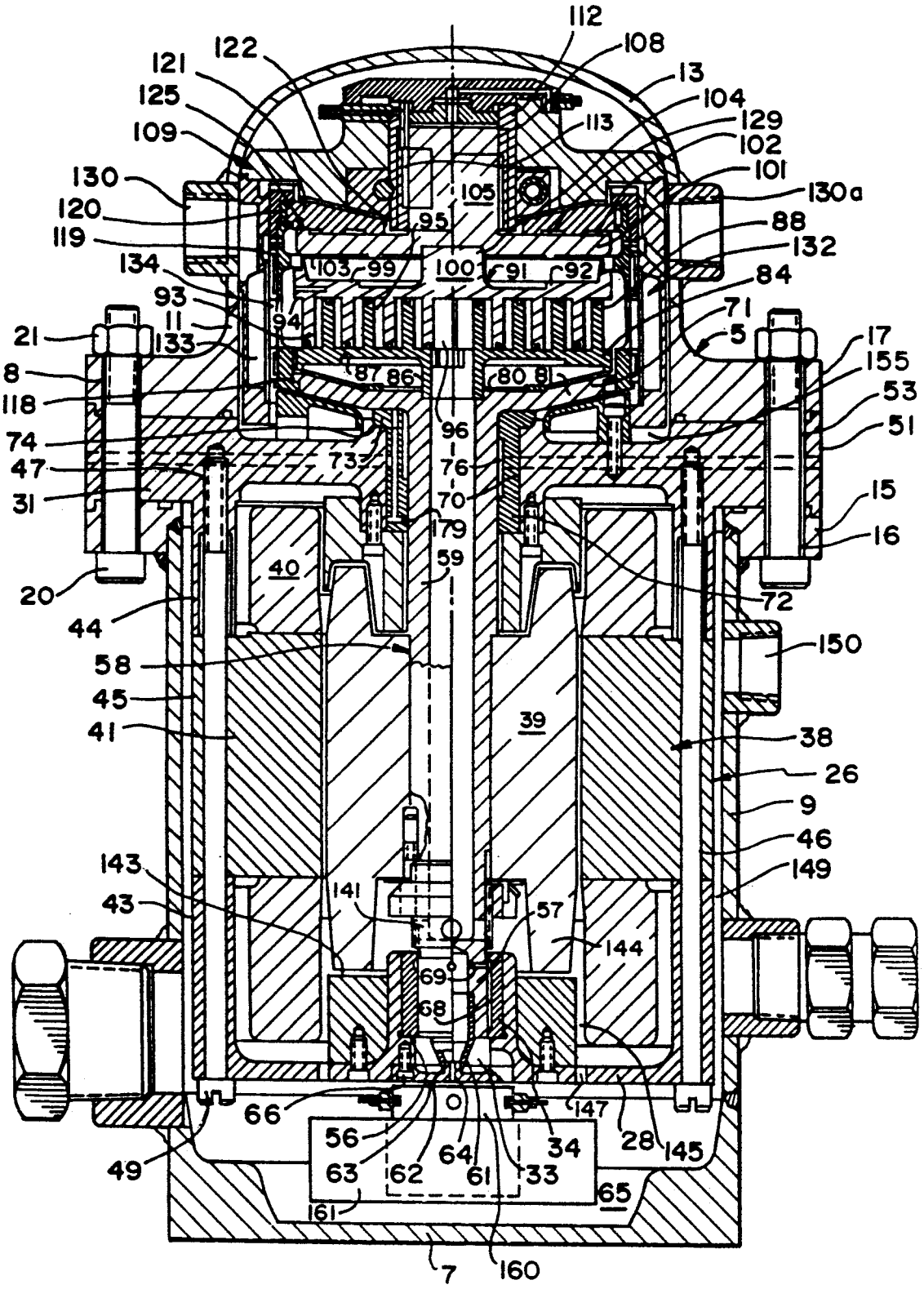
FIG. 1 is a cross-sectional elevation view of a co-rotating scroll-type refrigerant compressor incorporating an oil supply system in accordance with a first embodiment of the present invention.
Figure 2:
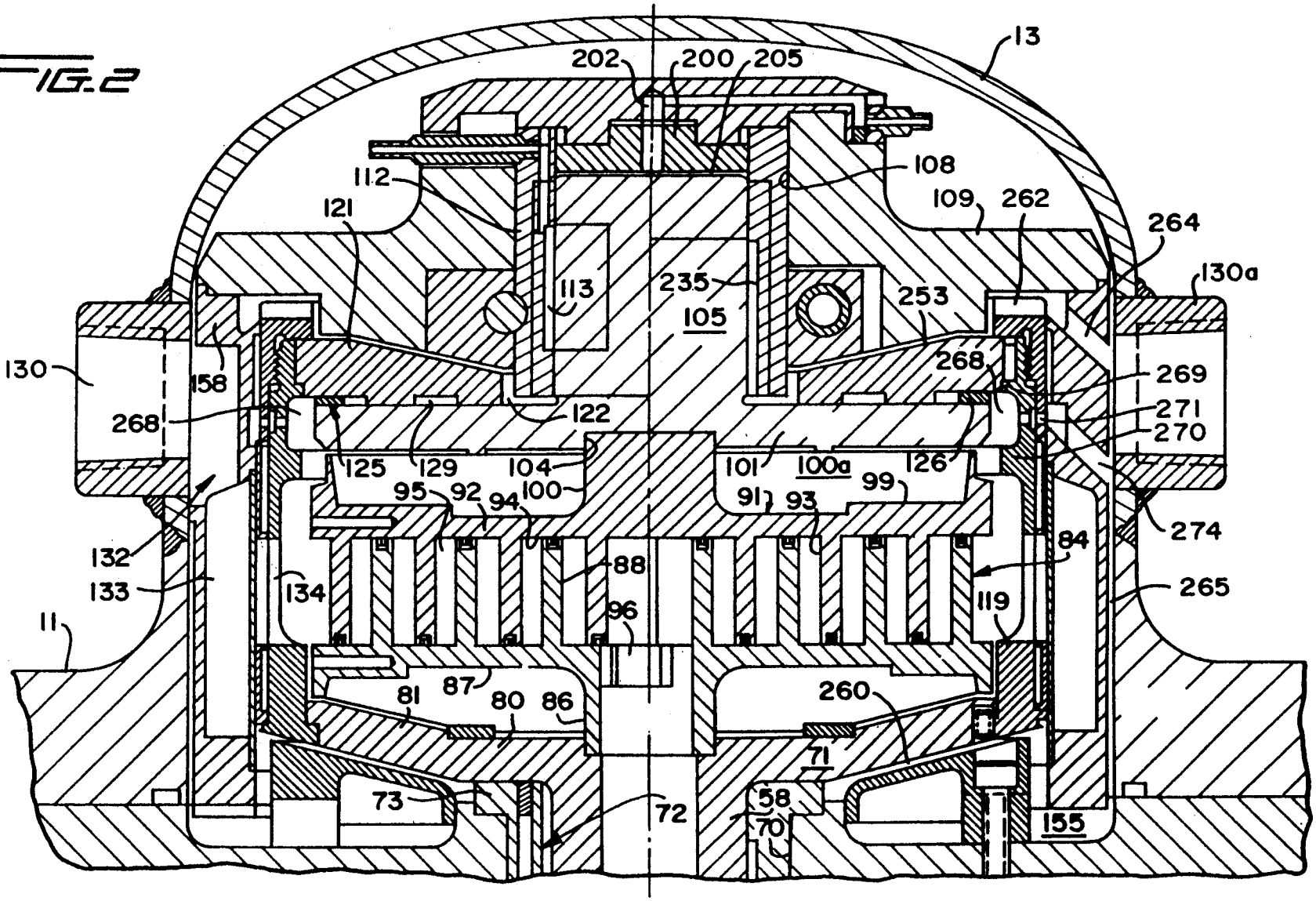
FIG. 2 is an expanded view of an upper section of the scroll-type compressor shown in FIG. 1.

With initial reference to FIGS. 1 and 2, a compressor is shown comprising a housing assembly 5 including a base plate 7, a lower housing section 9, an upper housing section 11 and a cover member 13. The upper end of lower housing section 9 includes a radially transversely extending annular flange 15 that is either integrally formed therewith or fixedly secured thereto by any means known in the art, such as by welding. Annular flange 15 has various circumferentially spaced apertures 16 extending substantially longitudinally therethrough. The lower end of upper housing section 11 also includes an annular flange 17 including various apertures 18 which are longitudinally aligned with apertures 16 for receiving fasteners such as bolts 20 and nuts 21 for fixedly securing upper housing section 11 to lower housing section 9 as will be more fully described herein.

Located within lower housing section 9 is a motor assembly 26. Motor assembly 26 comprises a bottom plate 28 and an upper crosspiece 31. Located in bottom plate 28 is a lower central cavity 33 defined by an upstanding annular bearing flange 34. Mounted within motor assembly 26 is an electric motor 38 including a rotor 39 rotatable about an longitudinal central axis; windings 40 and a lamination section 41. The exact mounting of motor 38 will be more fully discussed hereinafter.

As depicted, motor assembly 26 includes a lower skirt section 43 integrally formed with bottom plate 28, an upper skirt section 44 formed integral with crosspiece 31 and a central skirt section 45 which is part of lamination section 41. Lower, upper and central skirt sections 43, 44, 45 include aligned, elongated vertical apertures 46 extending therethrough at circumferentially spaced locations. Aligned with apertures 46, in crosspiece 31, is an internally threaded bore 47. Motor assembly 26 is secured together by various bolts 49 which extend through apertures 46 and are internally threaded into bore 47 of crosspiece 31.

Crosspiece 31 includes an annular flange 51 which mates with annular flange 15 of lower housing section 9 and annular flange 17 of upper housing section 11. Annular flange 51 further includes a plurality of circumferentially spaced apertures 53 which are aligned with apertures 16 and 18 formed in lower housing section 9 and upper housing section 11 respectively. Bolts 20 are adapted to extend through aligned apertures 16, 53 and 18 and nuts 21 are secured to the bolts 20 in order to fixedly secure upper housing section 11 to lower housing section 9 with crosspiece 31 therebetween. By this construction, motor assembly 26 is thereby secured within lower housing section 9.

Press-fit or otherwise secured within upstanding annular bearing flange 34 of bottom plate 28 is a lower bearing sleeve 56. Rotatably mounted within lower bearing sleeve 56 is a lower end 57 of a longitudinal extending hollow drive shaft 58. Drive shaft 58 includes an upper hollow section 59 separated by a partition from the lower end 57. Located within lower hollow end 57 is an oil cup 61 which tapers inwardly in a downward direction. Oil cup 61 is fixed to lower end 57 of drive shaft 58 and freely rotates about a central knob 62 formed in an attachment plate 63. Knob 62 includes a centrally located through-hole 64 communicating between the interior of oil cup 61 and a lower sump 65 in order to permit lubricating fluid to flow into and out of oil cup 61. Attachment plate 63 is secured to bottom plate 28 by means of various bolts 66. The oil drawn into oil cup 61 is used to supply oil to a lower drive shaft bearing 68 through passage 69.

Upper section 59 of drive shaft 58 extends through a central opening 70 in crosspiece 31 and terminates in an integrally formed drive plate 71. Central opening 70 houses an upper bearing sleeve 72 which includes an upper transverse flange 73 embedded in a recess 74 formed in an upper surface of crosspiece 31. Upper bearing sleeve 72 includes a bearing pad 76 for the introduction of a lubricating fluid bearing medium. Drive plate 71 is dish-shaped and includes a substantially horizontal, central portion 80 and an upwardly sloping outer portion 81.

Located above dish-shaped drive plate 71 is a drive scroll 84 that includes a central, hollow sleeve portion 86, a wrap support plate 87 and an involute spiral wrap 88. Central, hollow sleeve portion 86 is fixedly secure to drive shaft 58 through drive plate 71. Intermeshingly engaged with drive scroll 84 is a driven scroll 91 having a wrap support plate 92 with an involute spiral wrap 93 extending downwardly from a lower first side 94. As is known in the art, defined between involute spiral wrap 88 and involute spiral wrap 93 are fluid chambers 95 that, in this example, transport and compress gaseous refrigerant radially inwardly between the scroll flanks. Typically, the scroll fluid device would operate at a high speed within a gaseous fluid medium surrounding the rotating scroll wraps so that, when the device is operated as a compressor, fluid intake occurs at the outer end of each scroll wrap and output flow through the device occurs at central output port 96. Of course, it should be understood that such scroll fluid devices can be operated as expanders by admitting pressurized fluid at port 96 and causing it to expand within the radially outwardly moving fluid chambers 95, to be discharged at the outer ends of the scroll wraps. However, for the purposes of the remainder of this description, it will be assumed that the scroll fluid device illustrated is arranged to function as a compressor.

The upper, second side 99 of wrap support plate 92 is formed with an integral central projection 100. Disposed vertically above driven scroll 91 is a pressure plate 101 having an upper side surface 102 and a lower side surface 103. Formed in lower side surface 103 is a central recess 104 into which central projection 100 of driven scroll 91 extends and is fixedly secured therein. On upper side surface 102, opposite recess 104, pressure plate 101 is formed with an axially projecting bearing support shaft 105. Bearing support shaft 105 extends into a central bore hole 108 formed in a fixed support plate 109 in upper housing section 11.

In this embodiment, drive scroll 84 and driven scroll 91 co-rotate and therefore a bearing sleeve 112 is mounted within bore 108 and extends about the periphery of bearing shaft 105. In addition, bearing sleeve 112 includes a bearing pad passage 113, analogous to bearing pad 76 previously discussed, for the introduction of a lubricating fluid medium between bearing shaft 105 and bearing sleeve 112. It is possible, however, to fixedly secure driven scroll 91 and orbit drive scroll 84 about an orbit radius relative to scroll 91.

Extending upwardly from an outer perimeter 118 of drive plate 71 is an annular torque transmitting member 119. Secured to an upper, interior side wall 120 of torque transmitting member 119 is an annular bearing plate 121 having a central through-hole 122 therein through which bearing shaft 105 extends. An Oldham Coupling or synchronizer assembly, generally indicated at 125, is located between annular bearing plate 121 and upper side surface 102 of pressure plate 101 to maintain the drive and driven scrolls 84, 91 in fixed relationship in a rotational sense (i.e., so they cannot rotate relative to each other but maintain a fixed angular phase relationship relative to each other). Synchronizer assembly 125 comprises teeth 126 formed integral with the upper surface 102 of pressure plate 101 which extend into recesses 127 (see FIG. 3) formed in annular bearing plate 121. Annular bearing plate 121 also includes at least one thrust bearing chamber 129 for the introduction of high pressure oil to counteract the axial gas force developed and to lubricate synchronizer assembly 125 as will be discussed more fully below.

For a more complete description of the synchronizer assembly 125, in particular the relationship between teeth 126 and recesses 127, reference can be made to U.S. Pat. No. 4,927,340 granted May 22, 1990. In brief, the teeth 126 extend radially and have flat side wall surfaces extending into the grooves 127 between the flat groove side wall surfaces. The width of each recess or groove 127 corresponds to the maximum orbital excursion of the teeth side wall surfaces, with the teeth and groove side wall surfaces cooperating to prevent relative rotation between the scroll elements. Preferably, radial compliance between the scroll wraps can be achieved by arranging the synchronizer so that it permits motion of one wrap relative to the other in a direction extending generally along a line connecting the involute centers of the wraps. A single tooth 126 extends into each recess 127, all in the same manner as described in the aforesaid U.S. Pat. No. 4,927,340, which is incorporated herein by reference.

In order to drive the compressor, electric motor 38 operates in a conventional manner. Lamination section 41 is fixedly secured to upper and lower skirt sections 43, 44 of housing assembly 5. Rotor 39, on the other hand, is secured to drive shaft 58 such that when motor 38 is activated, rotation of rotor 39 causes rotation of drive shaft 58, drive plate 71, drive scroll 84, annular torque transmitting member 119, annular bearing plate 121 and, in the preferred embodiment, driven scroll 91 through the Oldham synchronizer assembly 125 acting through pressure plate 101.

Formed as part of housing assembly 5, between upper housing section 11 and cover member 13, is a housing inlet port 130 which opens up into an inlet manifold 132. Inlet manifold 132 includes an inlet passage 133 leading to a scroll inlet port 134 formed in annular torque transmitting member 119, adjacent the involute spiral wraps 88 and 93. The scroll fluid intake zone is provided inside the torque transmitting member 119 around the periphery of the scrolls. Another port **130*a*** may be provided optionally for instrumentation access.

As previously stated, when functioning as a compressor, gaseous refrigerant will enter the scroll fluid chambers 95 between spiral wraps 88, 93 through housing inlet port 130, inlet passage 133 and scroll inlet port 134. Upon activation of motor 38 and rotation of drive shaft 58, drive plate 71 and drive scroll 84, gaseous refrigerant will be pumped and compressed through the scroll device and will exit from scroll outlet port 96. Since scroll outlet port 96 opens into the hollow, upper section 59 of drive shaft 58, the compressed refrigerant will run downwardly through upper section 59. Just above lower end 57, drive shaft 58 includes a drive shaft outlet 141 which opens into motor assembly 26. Thus, refrigerant will be conducted through a passage 143 adjacent lower end 144 of rotor 39, through passage 145 adjacent windings 40 and into lower sump 65 through various outlet holes 147 formed in bottom plate 28. The refrigerant then moves along bottom plate 28, upwards through a clearance passage 149 formed between lower housing section 9 and motor housing 26, and out through a housing outlet port 150.

Reference will now be made to FIGS. 1–7 in describing a first embodiment of the lubrication supply system of the present invention. As previously stated, crosspiece 31 separates housing assembly 5 into a lower housing section 9 and an upper housing section 11. When the scroll fluid device is in operation, large axial thrust forces are exerted on drive and driven scrolls 84, 91 in the axial direction due to internal gas pressure. The axial thrust forces developed tend to separate drive scroll 84 from driven scroll 91. Such axial separation, if permitted, would cause leakage of the gaseous refrigerant from within scroll fluid chamber 95 and metal-to-metal contact at various locations within the scroll such as between central portion 80 of drive plate 71 and upper transverse flange 73 of bearing sleeve 72. In addition, high radial forces act on drive scroll 84 due to internal gas pressure tending to shift drive scroll 84 and drive shaft 58 (which is fixedly secured thereto as previously explained) to the right as viewed in FIGS. 1 and 2, while these same forces tend to shift driven scroll 91, pressure plate 101 and bearing shaft 105 to the left as viewed in these figures. In addition to the need to counteract these forces developed, the areas between the rotational and stationary parts of the compressor must be lubricated in order to reduce friction and subsequent wear, as well as to maintain appropriate operational temperatures.

The present invention contemplates an oil lubricant supply and bearing system which not only provides hydrostatic thrust bearing forces to counteract the axial and radial forces developed during operation of the compressor, but also results in hydrodynamic lubrication between relative rotating members of the compressor. By maintaining flow to these lubrication areas, the temperature increases resulting from frictional forces can be maintained at a safe operational level.

Figure 4:
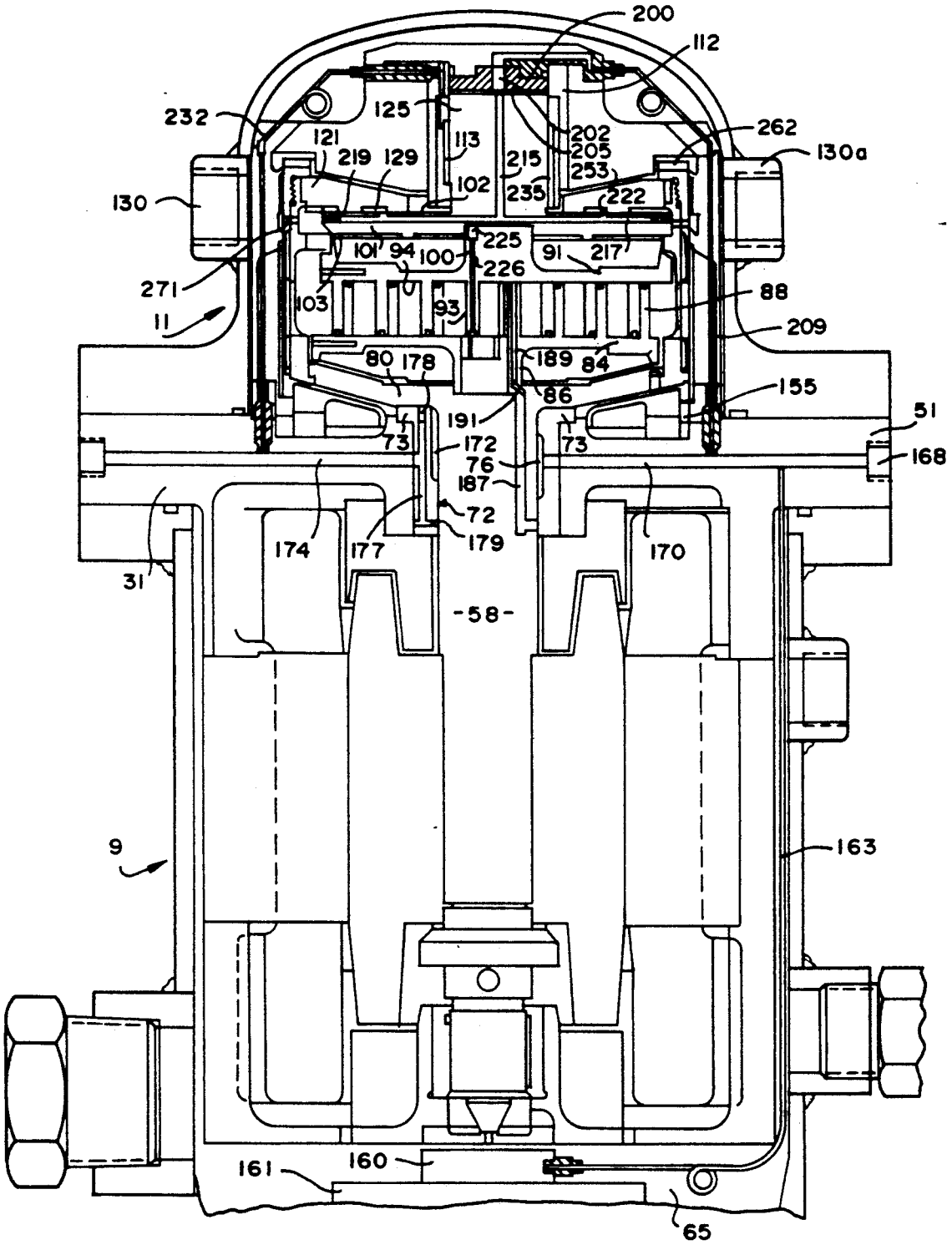
FIG. 4 is a cross-sectional elevation view of the scroll-type compressor, similar to that shown in FIG. 1 showing the various fluid passages of the oil supply system according to the first embodiment of the present invention.

With initial reference to FIGS. 1, 2 and 4, in addition to lower sump 65 previously discussed, the compressor arrangement of the present invention includes an upper sump 155. In general, upper sump 155 is maintained at a lower pressure than lower sump 65 which receives compressed refrigerant. Located within lower housing section 9, below motor housing 26, is a pump 160 which is driven by a motor 161. Pump 160 supplies the oil used to lubricate the scroll parts of the compressor and further supplies oil to various bearings and fluid seals as will be detailed below.

While the term "oil" is used herein with reference to the lubrication medium used in the scroll system, it is to be understood that any lubrication medium could be utilized as "oil".

Figure 5:
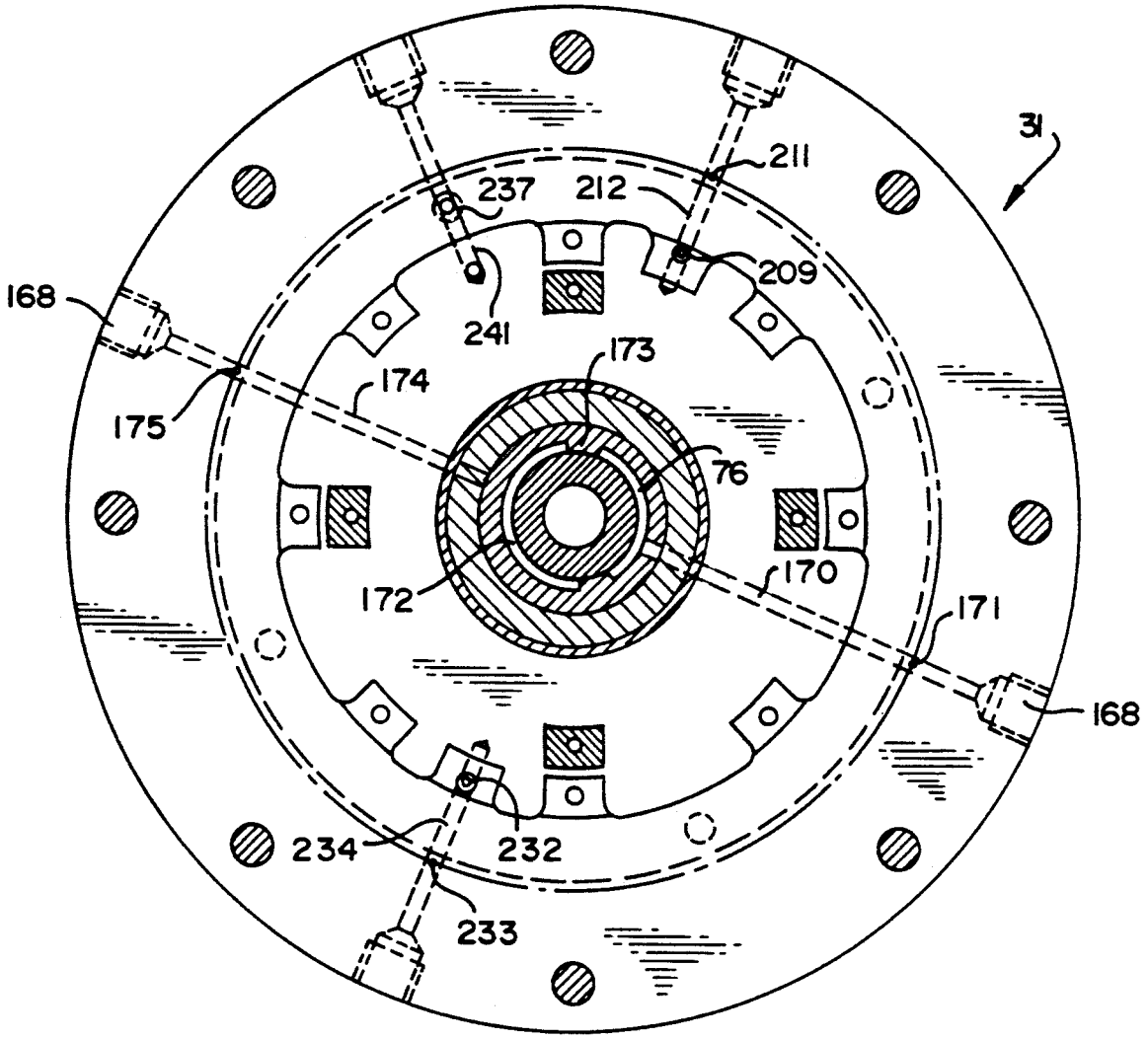
FIG. 5 is a top view of the upper crosspiece shown in FIGS. 1 and 4.

With specific reference to FIGS. 4 and 5, the output from pump 160 flows through a number of supply conduits 163 each of which supplies oil to a corresponding radial passage formed in crosspiece 31 as will be detailed below. Crosspiece 31 includes various lateral ports 168 each of which is associated with one of these radial passages. Lateral ports 168 may be used for viewing purposes or to provide access for instruments such as pressure sensors.

A first radial outlet passage 170 is formed within crosspiece 31 and feeds oil to hydrostatic bearing pad 76. First output passage 170 receives supply oil from a corresponding supply conduit 163 through orifice 171. As best shown in FIG. 5, bearing pad 76 extends only about a predetermined portion of the right half side of drive shaft 58. The fluid supply to bearing pad 76 functions to provide a radial thrust force on drive shaft 58 which counteracts the radial thrust force exerted by the refrigerant gas on drive scroll 84 as previously discussed. In addition, the fluid supplied to bearing pad 76 provides an additional lubrication function between drive shaft 58 and upper bearing sleeve 72 as will be more fully discussed herein. From viewing FIG. 5, it can readily be seen that upper bearing sleeve 72 further includes a clearance passage 172 which is separated from bearing pad 76 by means of lands 173. Clearance passage 172 further aids in the lubrication of drive shaft 58 as will be fully explained hereinafter.

Crosspiece 31 is also formed with a second radial output passage 174 which is in fluid communication with another supply conduit 163 through an orifice 175. Second output passage 174, as best shown in FIG. 4, is connected to a transfer duct 177 extending substantially vertically through upper bearing sleeve 72. Transfer duct 177 includes a plug 178 at an upper end thereof so that all of the lubricant flowing into transfer duct 177 is delivered to an annular drive shaft seal 179 which provides a fluid seal about drive shaft 58. As will be discussed more fully below, due to the relative size of orifices 171 and 175, the lubricant pressure supplied to annular drive shaft seal 179 is greater than the lubricant pressure supplied to hydrostatic bearing pad 76. The lubricant supplied to annular drive shaft seal 179 also communicates with a transfer duct to supply lubricating fluid between the tip seals (not labeled) carried by involute spiral wrap 88 of drive scroll 84 and lower first side 94 of driven scroll 91. As shown in FIG. 4, this transfer duct includes a first transfer section 187 formed in drive shaft 58, a second transfer section 189 extending through sleeve portion 86 and involute spiral wrap 88 of drive scroll 84, and a connecting duct portion 191. Due to the centrifugal forces developed by the rotating scroll elements, this lubricant will spread along the entire lower first side 94 of driven scroll 91 to provide the necessary lubrication between involute spiral wrap 88 and lower first side 94.

As depicted in FIG. 4, fixedly secured to upper housing section 11 above bearing shaft 105 is a cap member 200. Cap member 200 includes a central passageway 202 which opens into an axial thrust bearing chamber 205 located between cap member 200 and the upper surface of bearing shaft 105. Lubricant thrust bearing pressure is supplied to axial thrust bearing chamber 205 through first output conduit 209 (see FIG. 5) which is interconnected with a supply conduit 163 through orifice 211 and radial transfer passage 212.

Figure 3:
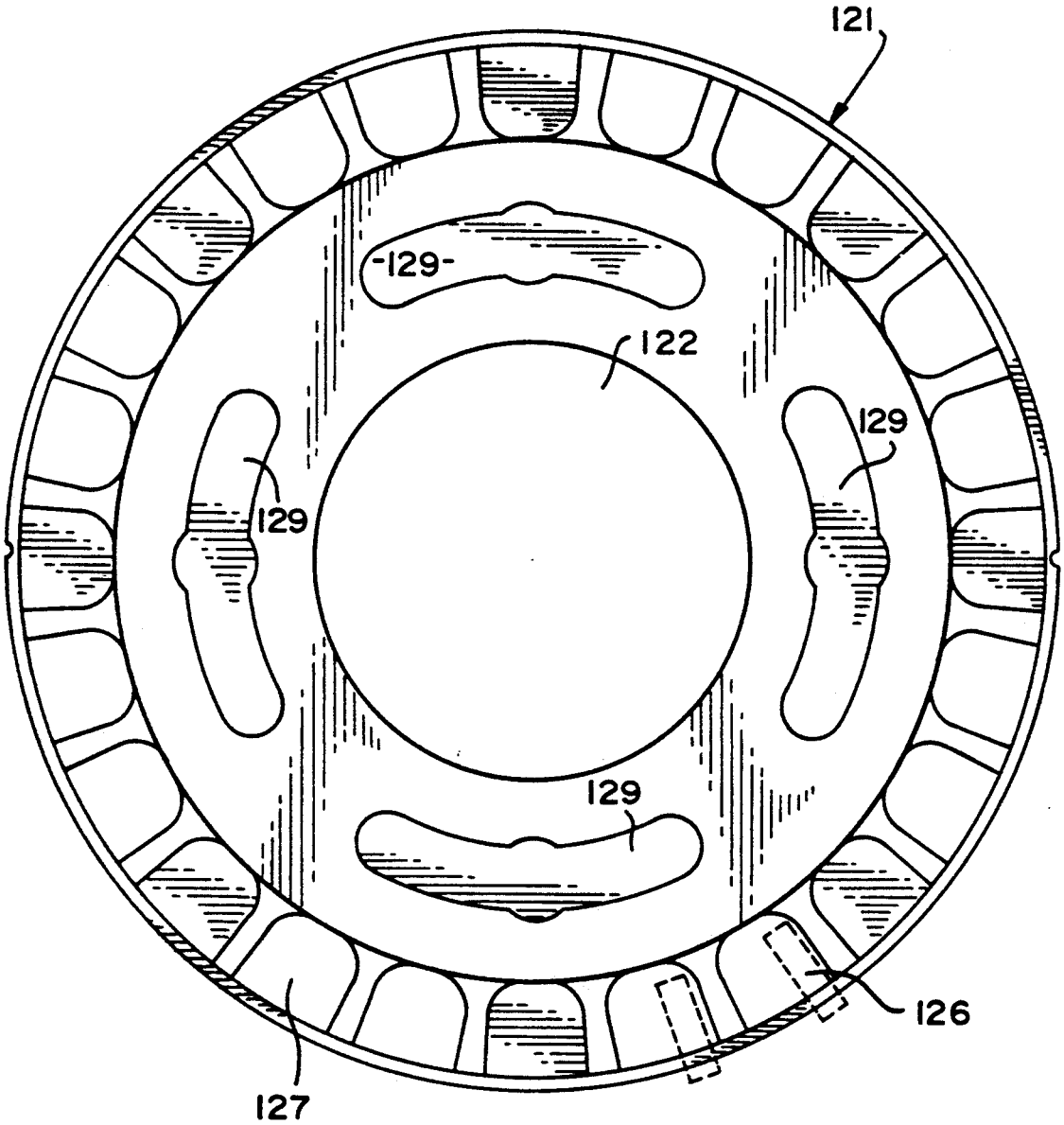
FIG. 3 is a bottom view of the annular bearing plate shown in FIGS. 1 and 2.

As previously discussed and best shown in FIG. 3, annular bearing plate 121 includes various thrust bearing chambers 129. In order to supply lubricant to chambers 129, pressure plate 101 includes various bore holes (4 in the preferred embodiment each of which corresponds to one of the thrust bearing chambers 129 shown in FIG. 3) comprising vertical sections 215 (FIG. 4) which are formed in bearing shaft 105 and horizontal sections 217 formed within pressure plate 101 between upper side surface 102 and lower side surface 103. As best shown in FIG. 4, the ends of horizontal sections 217 are plugged at 219. Each horizontal section 217 is in fluid communication with a corresponding thrust bearing chamber 129 by means of an opening 222.

As previously stated, the high pressures developed in fluid chambers 95 during operation of the scroll fluid device tend to separate drive scroll 84 from driven scroll 91 in the axial direction. Also, when the compressor is operating, an additional lower axial pressure load is developed which act on the cross-sectional area of shaft 58. The fluid that is supplied through first output conduit 209 to axial thrust bearing chamber 205 creates a reaction force between upper housing section 11 and bearing shaft 105 which functions to counteract this additional axial pressure load. Since annular bearing plate 121 is axially fixed relative to drive scroll 84 through torque transmitting member 119, drive plate 71 and central, hollow sleeve portion 86, lubricant pressure supplied to thrust bearing chambers 129 functions to maintain relative axial positioning of drive scroll 84 and driven scroll 91. Therefore, the axial separation force developed by the high pressure in fluid chambers 95 as discussed above are counterbalanced. The oil lubricant supplied to thrust bearing chambers 129 also functions to lubricate synchronizer assembly 125 as will be discussed more fully below.

The lubricant supplied to horizontal sections 217 is also in fluid communication, through a restrictor 225, with a transfer duct 226 which extends through central shaft 100 and involute spiral wrap 93 of driven scroll 91 and terminates at the tip of involute spiral wrap 93. The lubricant supplied through restrictor 225 into transfer duct 226 functions to lubricate the relatively orbiting surface between involute spiral wrap 93 and the upper surface of drive scroll 84 in a manner directly analogous to the fluid supplied through second transfer section 189 to lower first side 94 of driven scroll 91.

A second output conduit 232 is in fluid communication with a corresponding supply conduit 163 through an orifice 233 and a transfer passage 234 and supplies lubricant to hydrostatic bearing pad 113 formed in bearing sleeve 112. In a manner directly analogous to bearing pad passage 76 previously discussed, bearing pad 113 only extends around a predetermined portion of the left side of bearing shaft 105 as viewed in these figures and is separated from a clearance passage 235, also formed in bearing sleeve 112, by various lands (not shown). Again, the arrangement of bearing pad 113, clearance passage 235 and these lands is directly analogous to bearing pad 76, clearance passage 172 and lands 173 previously discussed. Also in a manner directly analogous to bearing pad 76, the lubricant supplied to bearing pad 113 provides a radial thrust force on bearing shaft 105 which functions to counteract the thrust force exerted by the compressed gas on the involute spiral wrap 93 of driven scroll 91 during operation of the scroll fluid device. In addition, the lubricant supplied to bearing pad 113 provides a lubrication function between bearing shaft 105 and bearing sleeve 112 and between annular bearing plate 121 and upper housing section 11, as will be more fully discussed below.

Figure 6:
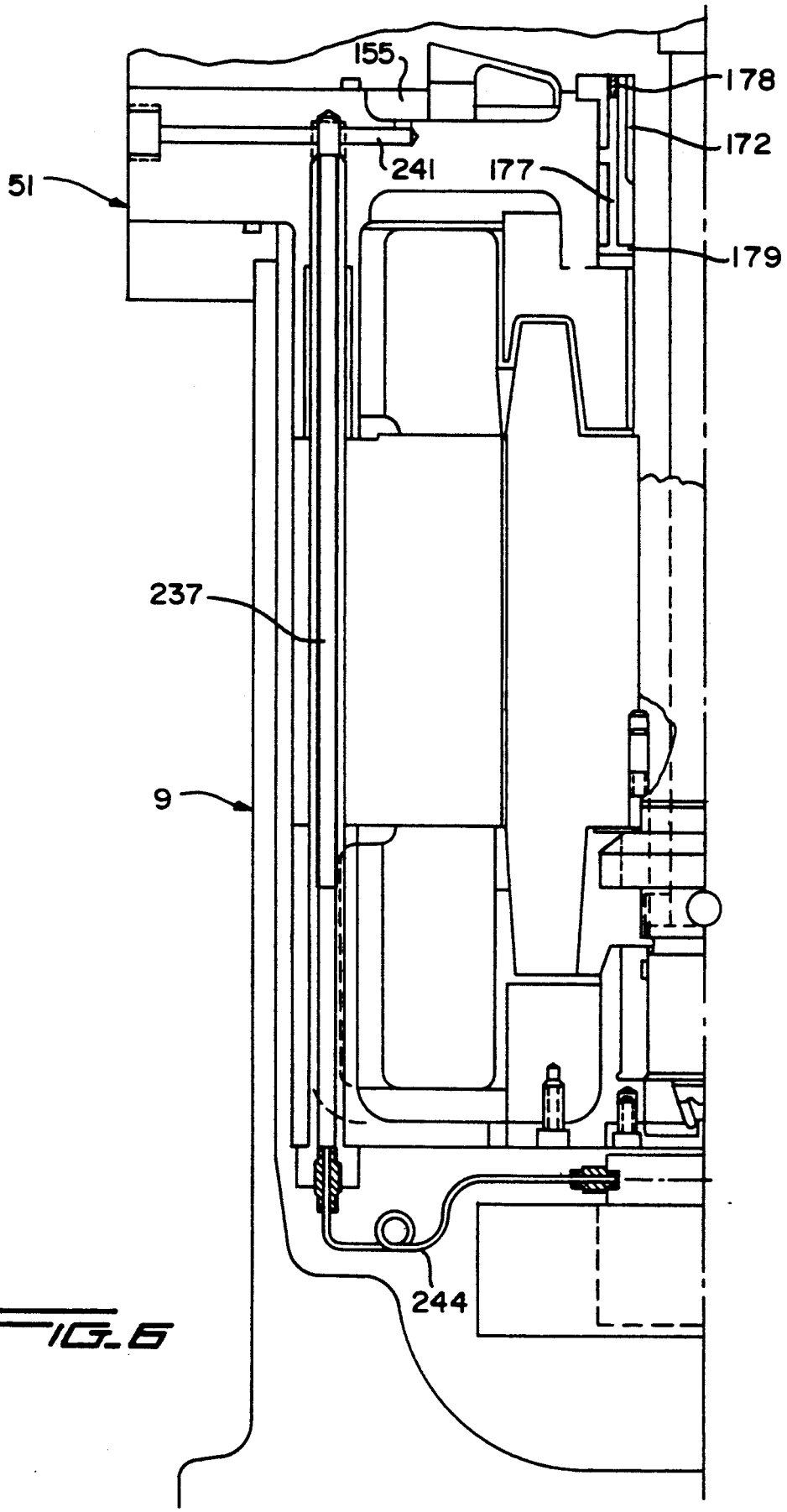
FIG. 6 is a cross-section elevational view of a section of the scroll-type compressor, similar to that shown in FIG. 4, depicting an oil return passage in detail.

The last of the output passages and conduits (a total of five in the preferred embodiment) comprises return passage 237 which, as best shown in FIG. 6, is interconnected with upper sump 155 through a lateral transfer duct section 241 and is connected to an intake port of pump 160 through a return conduit 244. It should be noted that although separate supply conduits 163 are provided for each of the output passages and conduits discussed above, it is possible to supply oil to a plurality of these output passages and conduits through a single supply conduit by interconnecting these outputs with an annular branching passage formed in crosspiece 31.

Reference will now be made specifically to FIGS. 2 and 4 in discussing the particular flow of pressurized lubricant from the above-discussed fluid chambers, conduits and passages to upper sump 155. As shown in these figures, the scroll fluid device of the present invention is not operating and therefore the lower surface of central portion 80 of drive plate 71 abuts upper transverse flange 73 of bearing sleeve 72 and a clearance passage 253 provided between annular bearing plate 121 and support plate 109 in upper housing section 11 is widened. In this embodiment, before the compressor is initially activated, pump 160 will be started by motor 161 to cause pressurized lubricant to flow into bearing pads 76 and 113, annular drive shaft seal 179, thrust bearing chambers 205 and 129, and through the transfer ducts 187, 189, 191 and 226 to provide lubrication between the relative orbiting involute scroll wraps 88,93. As previously stated, due to the relative sizes of orifices 171 and 175, the lubricant pressure supplied to annular drive shaft seal 179 will be greater than the lubricant pressure supplied to bearing pad 76. For example, if the scroll fluid device is utilized in an environment having ambient temperatures which results in a refrigerant gas pressure of approximately 200 psig acting between involute spiral wraps 88 and 93, the lubricant pressure supplied to annular drive shaft seal will be in the range of approximately 230 psig and the lubricant pressure supplied to bearing pad 76 will be approximately 175 psig. Since annular drive shaft seal 179 is located below bearing pad passage 76, pressurized lubricant from bearing pad 76 cannot flow downward between upper bearing sleeve 72 and drive shaft 58 beyond annular drive shaft seal 179. Instead, lubricant is forced to flow from bearing pad 76 upward between bearing sleeve 72 and drive shaft 58 and between upper transverse flange 73 and dish-shaped drive plate 71. The introduction of pressurized lubricant between transverse flange 73 and central portion 80 of drive plate 71 causes drive plate 71 to be slightly lifted off transverse flange 73 which results in a decrease in the size of clearance passage 253. Pressurized lubricant from bearing pad 76 also flows around drive shaft 58 between drive shaft 58 and lands 173 (FIG. 5) into clearance passage 172. The lubricant in clearance passage 172 again flows up between transverse flange 73 and drive plate 71. From here, the lubricant flows along upwardly sloping outer portion 81 of drive plate 71 and into upper sump 155.

In addition to the lubricant supplied to bearing pad 76, the higher pressurized lubricant supplied to annular drive shaft seal 179 can also flow upwardly between upper bearing sleeve 72 and drive shaft 58 and eventually into upper sump 155 in the same manner as the lubricant flowing from bearing pad passage 76. From this discussion, it can readily be seen that the pressurized lubricant supplied to bearing 76 not only performs the function of balancing the radial forces generated by operation of the compressor, but in conjunction with the lubricant supplied to annular drive shaft seal 179, functions to lubricate between drive shaft 58 and upper bearing sleeve 72. Due to a slight clearance between drive shaft 58 and lands 173, the pressure in clearance passage 172 is maintained at a minimal value and, given the above cited exemplary pressure figures, would be on the order of approximately 5 psig (due to the weight of drive and driven scrolls 84,91).

In a manner directly analogous to the supply of pressurized liquid lubricant to bearing pad 76, the pressurized lubricant supplied to bearing pad passage 113 not only functions to provide a reactive radial force to bearing shaft 105 but also provides lubrication between bearing shaft 105 and bearing sleeve 112 due to leakage around bearing shaft 105 and into clearance passage 235. From clearance passage 235, lubricant flows into central through-hole 122 formed in annular bearing plate 121, through clearance passage 253, into drain chamber 262, then through channel 264 (see FIG. 2) formed in inlet manifold 132 through passageway 265 between upper housing section 11, cover member 13 and inlet manifold 132, and into upper sump 155.

Axial thrust bearing chamber 205 not only provides an axial reactive thrust force but functions as a seal in a manner analogous to annular drive shaft seal 179. Due to this reason, the lubricant pressure supplied to axial thrust bearing chamber 205 is greater than that supplied to bearing pad passage 113. In general, this pressure difference is directly analogous to the differential created between annular drive shaft seal 179 and bearing pad passage 76 discussed above. Furthermore, the pressurized lubricant supplied to axial thrust bearing chamber 205 aids in providing lubrication between bearing shaft 105 and bearing sleeve 112 that will drain into clearance passage 253.

The pressurized lubricant supplied to thrust bearing chambers 129 in annular bearing plate 121 is forced radially outwardly by centrifugal forces, between pressure plate 101 and annular bearing plate 121, into synchronizer assembly 125. From there, the lubricant continues to flow outwardly into a lateral chamber 268 (FIG. 2) defined by upper and lower inwardly projecting flanges 269, 270 formed integral with torque transmitting member 119 in the vertical direction and pressure plate 101 and torque transmitting member 119 in the horizontal direction. From lateral chamber 268, the lubricant drains through bore hole 271 formed in torque transmitting member 119, into channel 274 formed in inlet manifold 132 leading to passageway 265 between upper housing section 11, cover member 13 and inlet manifold 132, and into upper sump 155.

As previously discussed, thrust bearing chamber 129 of the present invention maintains relative axial positioning of drive scroll 84 and driven scroll 91 due to the interconnection of annular bearing plate 121 with drive scroll 84 through annular torque transmitting member 119. Thrust bearing chambers 129 are dimensioned so as to provide for a significantly greater oil film thickness (on the order of approximately 5 mils) than known prior art arrangements. This added film thickness significantly reduces power losses due to frictional forces during high speed operation of the compressor. In addition, since additional axial thrust reaction forces are provided, the size of annular bearing plate 121 can be reduced so as to avoid efficiency loss and vibration problems. Furthermore, scroll temperature is controlled by the present arrangement due to the fact that inwardly projecting flange 270 directs the draining lubricant continuously away from the co-rotating scroll elements. Channels 264 and 274, along with passageway 265, also minimize heat transfer between the hot lubricating oil and the inlet gaseous refrigerant by directing the oil away from inlet passage 133 of inlet manifold 132.

Figure 7:
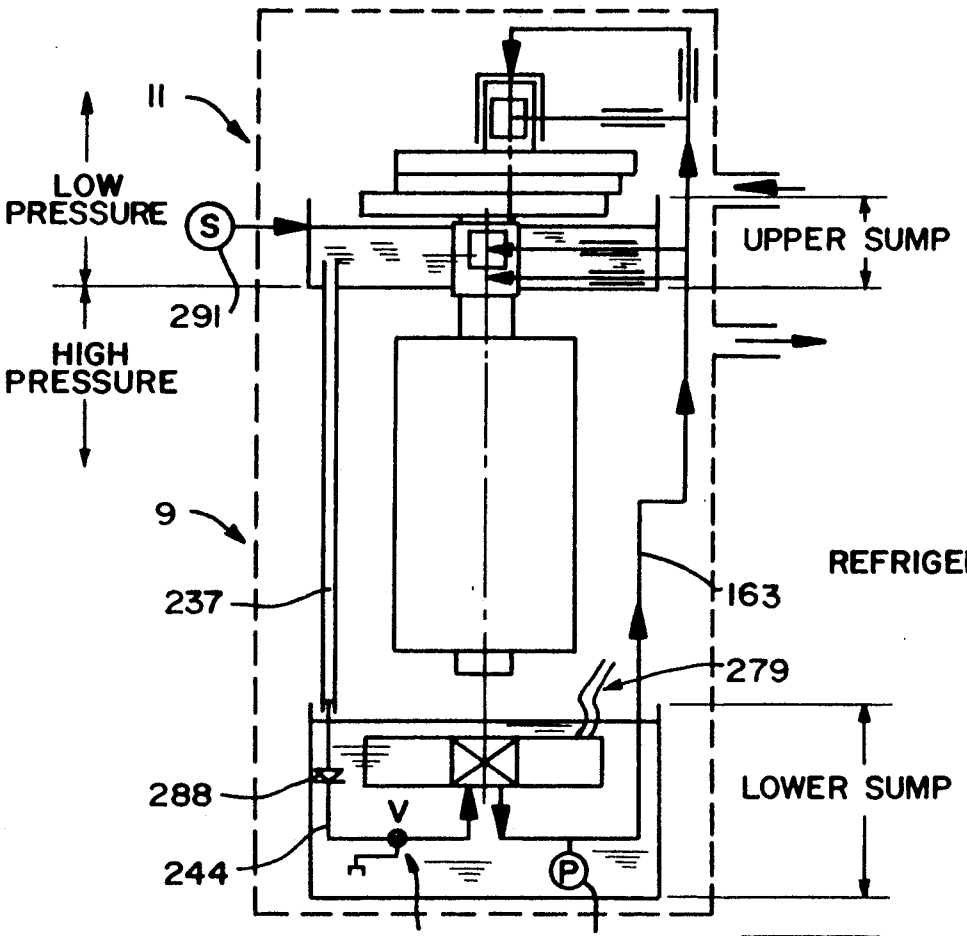
FIG. 7 is a schematic view of the scroll-type compressor incorporating the oil supply system according to the first embodiment of the present invention.

Reference will now be made to FIG. 7 in describing the manner in which pump 160 draws lubricant from lower sump 65 and/or upper sump 155 in the first embodiment. Generally indicated at 279 are electrical leads for motor 161 used to drive pump 160. Located within supply conduit 163 is a pressure sensor 281. Pressure sensor 281 functions through a switching element (not shown) to control the activation of motor 161 and, hence pump 160, in dependence upon the sensed pressure in supply conduit 163. For instance, using the above exemplary pressure figures, pressure sensor 281 would be calibrated to activate motor 161 whenever the pressure in supply conduit 163 falls below 235 psig.

Indicated at 286 is a two position valve, for example, a solenoid valve. In its first position, valve 286 interconnects the intake of pump 160 with the lubricant oil in lower sump 65. In its other position, valve 286 interconnects return passage 237 and return conduit 244 with the intake of pump 160 such that lubricant is drained from upper sump 155. Lubricant is taken from upper sump 155 through a check valve generally indicated at 288. Valve 286 is controlled based on the output signal from an oil level sensor 291 which senses the level of lubricant in upper sump 155. In general, when the lubricant level in upper sump 155 exceeds a predetermined level, valve 286 is switched to interconnect upper sump 155 with the intake of pump 160 so as to prevent the oil in upper sump 155 from raising the temperature of the gaseous refrigerant in inlet passage 133.

When the compressor is initially turned on, level sensor 291 may indicate a low level of lubricant in upper sump 155 and pressure sensor 281 will indicate a pressure less than the predetermined desired operating pressure. Based on these signals, pump 160 will intake lubricant from lower sump 65 and build up a pressure prior to initial rotation of drive shaft 58. This initial pressure will be supplied to the hydrostatic bearings, thrust chambers, seals etc. described above and will lift drive plate 71 off upper transverse flange 73 as previously discussed.

When the compressor is running, if level sensor 291 indicates a high level of lubricant in upper sump 155, valve 286 will be switched to cause lubricant to be taken into pump 160 from upper sump 155 instead of lower sump 65. After the lubricant level in upper sump 155 is reduced below a predetermined amount, valve 286 will again be switched by the output from level sensor 291 to cause lubricant to be drawn from lower sump 65. If the pressure sensor 281 indicates an output pressure greater than a predetermined desired value, motor 161 and pump 160 can be shut down or, alternatively, the operating speed of motor 161 can be reduced until the pressure in supply conduit 163 again falls below that predetermined value. After the compressor is shut off, the motor and pump continue to run, drawing lubricant from lower sump 65, for example, until the compressor completely stops.

It will be understood that since the lower housing is pressurized by compressed refrigerant during normal operation of the compressor, the lower sump 65 will be pressurized by the compressed refrigerant as well. The pressurization of the lower sump provides a pressure head on the lubricant in the lower sump that tends to circulate lubricant to the hydrostatic, thrust and other bearing devices in the upper and lower pressure housing portion. Accordingly, the pump 160 only needs to be operational upon start-up of the scroll compressor and until the pressure in the lower part of the housing is sufficient to generate an adequate pressure head on the lubricant, i.e., to the predetermined desired pressurization value.

Figure 9:
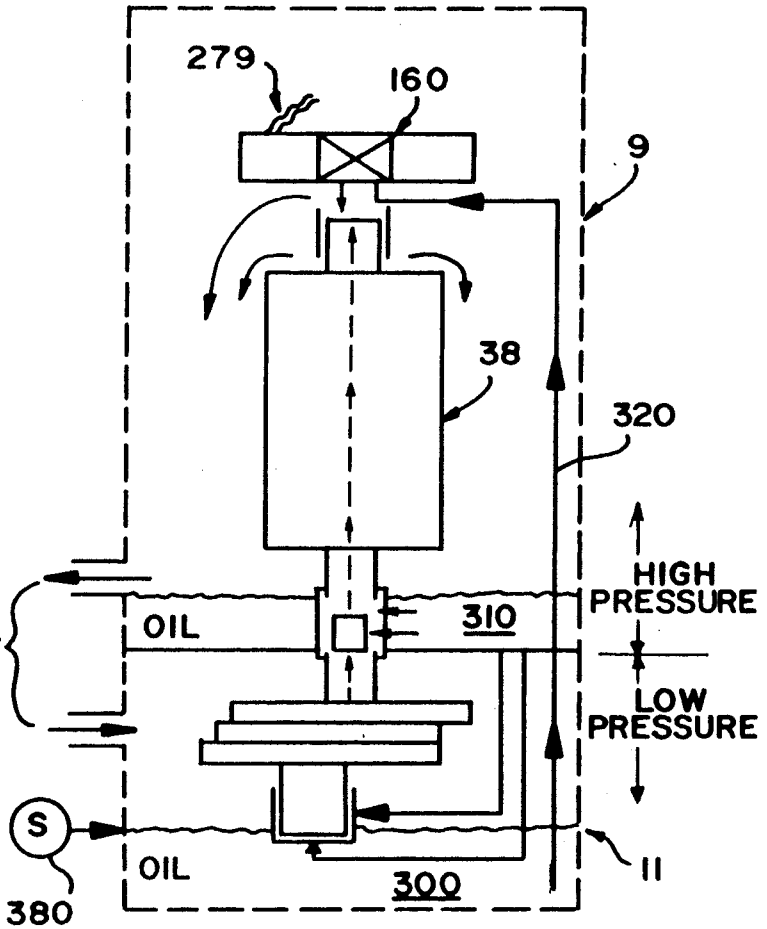
FIG. 9 is a schematic view similar to that shown in FIG. 7 but depicting the second embodiment of the invention.
Figure 8:
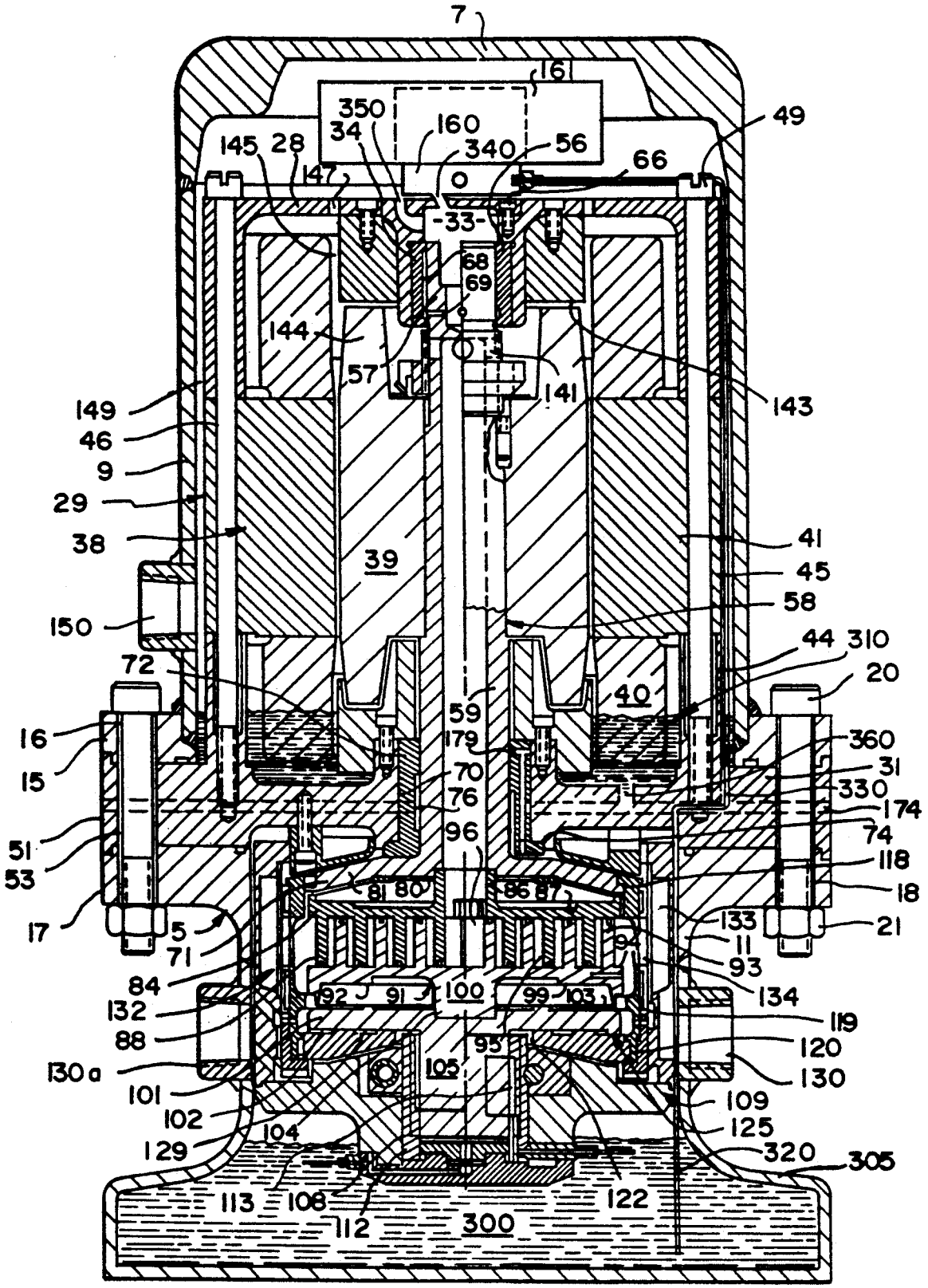
FIG. 8 is a cross-sectional elevation view of a co-rotating scroll-type refrigerant compressor incorporating an oil supply system in accordance with a second embodiment of the present invention.

Reference will now be made to FIGS. 8 and 9 which depict a second embodiment of the present invention wherein like reference numerals have been utilized to indicate corresponding parts to that described above with reference to the first embodiment. In general, the FIG. 8 embodiment depicts a scroll-type compressor which has been inverted relative to the arrangement shown in FIG. 1. Although the majority of the components of the scroll-type compressor of the second embodiment are identical to that described above with reference to the first embodiment so a duplicate description thereof will not be provided here, various modifications in the oil supply system are present along with a few structural changes as will be discussed in detail below.

With initial reference to FIG. 8, the scroll-type compressor includes a lower sump 300 defined within a hollow base 305 and an upper sump 310 defined above crosspiece 31 within housing section 9. In general, lower sump 300 is maintained at a lower pressure than upper sump 310. Pump 160 draws fluid from lower sump 300 by means of a conduit 320 which is connected to pump 160, extends down clearance passage 149 and through a transfer passage 330 into second output passage 174. From second output passage 174, conduit 320 extends into lower sump 300 in a manner analogous to that described above with reference to the manner in which second output conduit 232 extends within upper housing section 11.

The output from pump 160 flows through a duct 340 which opens into cavity 33. At this point it should be noted that the scroll-type compressor of the second embodiment does not utilize an oil cup arrangement, analogous to that described with reference to the first embodiment, to feed oil to drive shaft bearing 68. Instead, high pressure oil from pump 160 is permitted to freely flow from cavity 33 into passage 69 through lower hollow end 57 of drive shaft 58 to supply oil to the drive shaft bearing 68.

In addition to the oil that seeps between drive shaft 58 and drive shaft seal 68 during operation of the scroll-type compressor, overflow oil can pass through a duct 350 formed between annular bearing flange 34 and attachment plate 63. This overflow oil may then freely flow into motor assembly 26 through clearance passage 147 to lubricate and cool the rotating elements located therein. Additional fluid flow may pass through clearance passage 149. As evident from viewing FIG. 8, the oil in each of these flow paths will drain due to gravity into upper sump 310.

The high pressure fluid in upper sump 310 is connected by various supply conduits (one of which is shown at 360 in FIG. 8) which are generally analogous to supply conduits 163 utilized in the first embodiment of the invention in that they supply high pressure fluid to the radial output passages and conduits 170, 174, 209 and 232. In this manner, high pressure oil for bearing and lubrication purposes are distributed in a manner directly analogous to that described with reference to FIGS. 4–6 of the first embodiment. However, in the FIG. 8 embodiment, no restrictors are utilized such that the sizes of orifices 171, 175, 211 and 233 are the same. Therefore, the fluid pressure supplied to each of the bearings and seals are equal to the pressure in upper sump 310. The pressure supplied to thrust chamber 205 counteracts the axial force (static force) exerted on drive shaft 58 from within motor assembly 26 and the pressure supplied to thrust chambers 129 counteracts the axial force developed between the wrap support plates 87, 92 during operation of the compressor. In addition, in the second embodiment, gravitational forces aid in the distribution of the oil from upper sump 310 to the bearings and shaft seals between the high and low pressure zones defined above and below crosspiece 31.

Particular reference will now be made to FIG. 9 in describing the manner in which pump 160 draws lubricant from lower sump 300. During initial startup or after extended non-use periods of the scroll-type compressor, a high level of fluid will collect in lower sump 300 due to gravity. A level sensor 380 is used to monitor the level of oil in lower sump 300 and to control the operating speed of pump 160. That is, depending upon the level of oil sensed by sensor 380, the rate at which pump 160 draws oil from the low pressure sump 300 through conduit 320 to the high pressure zone is controlled. Therefore, in this embodiment, pump 160 can operate continuously at variable speeds or be turned off to keep the low pressure zone oil level in a desired range. Variable speed pumps which can operate in accordance with the present invention are widely known in the art. In general, the higher the oil level sensed in lower sump 300, the higher the speed at which pump 160 will be operated. Furthermore, pump 160 will be operated in such a manner so as to assure that a minimum oil level in upper sump 310 is always kept above the level of annular drive shaft seal 179 to ensure that the seal never runs dry.

When level sensor 380 registers a high oil level in lower sump 300, pump 160 is controlled to operate at a high speed to ensure that upper sump 310 is full enough to provide oil to the seals and bearings. In general, when the compressor is initially started, the pump 160 will be operated at a high speed since a majority of the fluid will have drained into lower sump 300. Initially, the static head of the oil feeding bearings will be sufficient for starting. As the system pressure builds, the oil pressure will also increase. During normal operation of the compressor, the pump speed is varied based on the monitored oil level in lower sump 300 as discussed above. When the compressor is turned off, pump 160 also stops. At this point, some oil will flood the bearings until the system pressure equalizes and some oil seepage, due to the pressure differential and gravity, will occur thereafter.

It should be noted that the second embodiment has some advantages over the lubrication system of the first embodiment described above. For instance, the second embodiment has fewer components for lower cost and improved reliability. For example, there is no need for an oil cup or fluid flow restrictors which could potentially clog. In addition, during initial startup of the compressor, pump 160 does not have to intake lubricant from the lower sump to build up a pressure prior to initial rotation of the drive shaft due to the location of high pressure sump 310 and the inherent gravity feed system. Of course, depending upon the remaining refrigerant system volume and design, the initial scroll gas loads may be too much for the bearings, in which case, a refrigerant discharge pressure control valve may be used to achieve a rapid oil pressure rise. In addition, if the oil pump in the second embodiment should fail, the level of oil in lower sump 300 will rise until it submerges the scrolls, thus flooding the scroll inlets. Under these conditions, the scrolls begin to ingest oil and pump it along with the refrigerant. Therefore, under these extreme circumstances, the scrolls take over the pumping of oil as well as the compression of refrigerant. In this manner, the compressor is not damaged although efficiency is decreased.

Although described with respect to preferred embodiments of the invention, it should be understood that various changes and/or modifications can be made by a person skilled in the art without departing from the spirit and scope of the invention as indicated in the appended claims.

We claim:

1. A scroll fluid device comprising:

a housing;

a pair of intermeshing axially extending involute spiral wraps mounted in the housing for relative orbital movement about an orbit center without relative rotation to provide at least one periodically and cyclically varying volume fluid transport chamber movable radially between the wraps;

axially spaced wrap support plates having said involute wraps disposed on respective opposing facing sides of said plates;

synchronizer means for maintaining said wraps in a predetermined rotational phase relationship;

means for supplying fluid to an intake zone associated with the wraps and for conveying transported fluid away from the wraps;

fluid bearing means for reacting axial thrust and radial side loads generated during operation of the scroll fluid device, said bearing means including at least one hydrostatic bearing;

drive means in the housing for driving the wrap support plates in relative orbital motion; and means for supplying pressurized lubricant to said fluid bearing means, said means for supplying pressurized lubricant being separate and distinct from said fluid supplying means.

2. A scroll fluid device as claimed in claim 1, wherein said hydrostatic bearing reacts axial thrust loads between the wrap support plates.

3. A scroll fluid device as claimed in claim 2, wherein said at least one hydrostatic bearing comprises a cooperating pair of opposed bearing elements, said synchronizer means being disposed between said bearing elements.

4. A scroll fluid device as claimed in claim 3, wherein said spiral wraps are mounted for co-rotation by said drive means, and said synchronizer means is disposed radially outwardly of said at least one hydrostatic bearing, whereby lubricant supplied to the hydrostatic bearing may flow centrifugally from said hydrostatic bearing to said synchronizer means during operation of the scroll fluid device.

5. A scroll fluid device as claimed in claim 1, wherein said drive means includes a shaft drivingly connected to a first one of said wrap support plates and a torque transfer means connecting the drive means to the other wrap support plate through said synchronizer means.

6. A scroll fluid device as claimed in claim 5, wherein said torque transfer means extends about said involute spiral wraps.

7. A scroll fluid device as claimed in claim 6, wherein said torque transfer means comprises a drive plate, an annular torque transmitting member having first and second ends and a bearing plate; said torque transfer means being arranged with said drive plate being fixedly secured to said first one of said wrap support plates, said first end of said torque transmitting member being fixedly secured to said drive plate, and said torque transmitting member extending about said involute scroll wraps and having said second end thereof fixedly secured to said bearing plate; said synchronizer means acting between said bearing plate and said other of said wrap support plates.

8. A scroll fluid device as claimed in claim 7, further including a pressure plate fixedly secured to said other wrap support plate on a side opposite said opposing facing side, said synchronizer means and said at least one hydrostatic bearing being disposed between said bearing plate and said pressure plate.

9. A scroll fluid device as claimed in claim 8, wherein said synchronizer means comprises axially extending teeth associated with one of said bearing and pressure plates and axially extending recesses associated with the other one of said bearing and pressure plates, said teeth and recesses being interdigited;

said teeth comprising radially and circumferentially extending elements having flat circumferentially spaced teeth side wall surfaces, said recesses defined by generally radially extending flat recess side wall surfaces;

each of said teeth side wall surfaces being separated by a tooth width and each of said recess side wall surfaces being separated by a recess width, and wherein said recess width corresponds to the maximum orbital excursion of the teeth side wall surfaces, said teeth and recess side wall surfaces cooperating to prevent relative rotation between said involute spiral wraps while accommodating their relative orbital motion.

10. A scroll fluid device as claimed in claim 9, wherein said teeth are carried by said pressure plate at circumferentially spaced intervals and said recesses are formed in said bearing plate.

11. A scroll fluid device as claimed in claim 1, wherein said housing is sealed, said wraps are arranged to compress a gaseous refrigerant and said fluid supplying and conveying means supply and carry a gaseous refrigerant; said drive means comprising a drive motor within the housing; said housing including at least one lubricant supply sump arranged to supply lubricant to the lubricant supply means and to receive return lubricant from the bearing devices.

12. A scroll fluid device as claimed in claim 11, wherein said drive means includes a drive shaft drivingly connected to a first one of said wrap support plates, said drive shaft being hollow and defining a transport passage therein, said means for conveying fluid away from said wraps includes said transport passage.

13. A scroll fluid device as claimed in claim 11, wherein said housing is divided into a high pressure section that receives compressed refrigerant from the spiral wraps during scroll fluid device operation and a lower pressure section including the spiral wraps and said intake zone; a high pressure section lubricant supply sump in said high pressure housing section and a low pressure lubricant supply sump in said lower pressure housing section; means providing selective communication between said sumps and at least one of said sumps and said lubricant supply means.

14. A scroll fluid device as claimed in claim 13, wherein said lubricant supply means includes a pump.

15. A scroll fluid device as claimed in claim 14, wherein said pump is operable at variable speeds.

16. A scroll fluid device as claimed in claim 13, wherein said high and lower pressure sections are divided by a housing crosspiece.

17. A scroll fluid device as claimed in claim 16, wherein said lubricant supply means includes at least one radial passage formed in said crosspiece.

18. A scroll fluid device as claimed in claim 14, wherein said means for providing selective communication between at least one of said sumps and said lubricant supply means includes means for sensing the level of lubricant in the low pressure lubricant supply sump and means for directing lubricant from the low pressure lubricant supply sump to the lubricant pump in response to sensed lubricant level in said low pressure lubricant supply sump.

19. A scroll fluid device as claimed in claim 1, further including an axial support shaft connected to one of said wrap support plates; said bearing devices including a second hydrostatic bearing supporting said axial support shaft radially relative to said housing; and a shaft thrust bearing for reacting axial loads imposed against the housing by said axial support shaft; said lubricant supply means being arranged to supply pressurized lubricant to said second hydrostatic bearing and said shaft bearing.

20. A scroll fluid device as claimed in claim 5, including a second hydrostatic bearing positioned between said shaft and the housing for supporting said shaft relative to the housing, said lubricant supply means being arranged to supply pressurized lubricant to said second hydrostatic bearing.

21. A method of lubricating bearing devices including at least one hydrostatic bearing in an integrated motor scroll fluid compressor including a two-part sealed housing containing the scroll device and its associated motor, said housing having a high pressure section containing the motor and pressurized by compressor output fluid, and a low pressure section containing intermeshing involute scroll wraps and a fluid intake zone, comprising:

providing individual lubricant supply sumps in the high and low pressure sections, with at least the sump in the high pressure section pressurized by compressor output fluid, and providing lubricant supply and return conduits and flow paths between the sumps and the bearing devices;

providing a motor driven lubricant pump for circulating lubricant between at least one of the sumps and the bearing devices through the conduits and flow paths;

providing a sensor for sensing the level of lubricant in at least one of the high and low sumps; and providing a means for supplying lubricant from at least one of the low and high pressure section sumps to the pump for circulation to the bearing devices based on the level of lubricant sensed.

22. A method as claimed in claim 21, including providing a valve means for controlling the supply of lubricant from the low pressure section sump to the lubricant pump and controlling the valve means to cause the lubricant pump to draw lubricant from the low pressure section sump when the level of lubricant therein exceeds a predetermined level.

23. A method as claimed in claim 22, including deactivating the lubricant pump when lubricant level in the low pressure housing falls below a predetermined level.

24. A method as claimed in claim 21, including varying the operational speed of the motor driven lubricant pump based on the level of lubricant sensed.

* * * * *